US009121247B2

(12) United States Patent
George et al.

(10) Patent No.: US 9,121,247 B2
(45) Date of Patent: Sep. 1, 2015

(54) METHOD AND APPARATUS FOR ESTABLISHING INJECTION INTO A CASED BORE HOLE USING A TIME DELAY TOE INJECTION APPARATUS

(71) Applicant: GEODynamics, Inc., Millsap, TX (US)

(72) Inventors: Kevin R. George, Clebume, TX (US); James A. Rollins, Lipan, TX (US); David S. Wesson, The Woodlands, TX (US)

(73) Assignee: GEODYNAMICS, INC., Millsap, TX (US)

( * ) Notice: Subject to any disclaimer, the term of this patent is extended or adjusted under 35 U.S.C. 154(b) by 274 days.

(21) Appl. No.: 13/788,068

(22) Filed: Mar. 7, 2013

(65) Prior Publication Data

US 2014/0251619 A1 Sep. 11, 2014

(51) Int. Cl.

| | |
|---|---|
| ***E21B 34/06*** | (2006.01) |
| ***E21B 34/10*** | (2006.01) |
| *E21B 34/00* | (2006.01) |

(52) U.S. Cl.

CPC ..... *E21B 34/063* (2013.01); *E21B 34/06* (2013.01); *E21B 34/108* (2013.01); *E21B 2034/007* (2013.01)

(58) Field of Classification Search

CPC ..... E21B 34/063; E21B 34/06; E21B 34/08; E21B 2034/007

See application file for complete search history.

(56) References Cited

U.S. PATENT DOCUMENTS

| | | | | |
|---|---|---|---|---|
| 7,849,925 | B2 * | 12/2010 | Patel | 166/334.4 |
| 8,245,788 | B2 * | 8/2012 | Garcia et al. | 166/373 |
| 2003/0221837 | A1 * | 12/2003 | Giroux et al. | 166/373 |
| 2010/0314562 | A1 * | 12/2010 | Bisset | 251/12 |
| 2013/0025872 | A1 * | 1/2013 | Mailand et al. | 166/332.1 |
| 2013/0292133 | A1 * | 11/2013 | Thompson | 166/373 |

* cited by examiner

*Primary Examiner* — Yong-Suk (Philip) Ro

(74) *Attorney, Agent, or Firm* — David W. Carstens; Sudhakar V. Allada; Carstens & Cahoon, LLP

(57) ABSTRACT

An apparatus and method for providing a time delay in injection of pressured fluid into a geologic formation. In one aspect the invention a toe valve activated by fluid pressure that opens ports after a predetermined time interval to allow fluid to pass from a well casing to a formation. The controller time delay enables casing integrity testing before fluid is passed through the ports. This time delay also allows multiple valves to be used in the same well casing and provide a focused jetting action to better penetrate a concrete casing lining.

28 Claims, 4 Drawing Sheets

METHOD AND APPARATUS FOR ESTABLISHING INJECTION INTO A CASED BORE HOLE USING A TIME DELAY TOE INJECTION APPARATUS

BACKGROUND

1. Field

An apparatus and method for providing a time delay in injection of pressured fluid into a geologic formation. More specifically, it is a toe valve activated by fluid pressure that opens ports after a predetermined time interval to allow fluid to pass from a well casing to a formation.

2. Background

It has become a common practice to install a pressure responsive opening device at the bottom or toe of a casing string within a horizontal well bore. These devices are made up and run as an integral part of the casing string. After the casing has been cemented and allowed to solidify, the applied surface pressure is combined with the hydrostatic pressure and the pressure responsive valve is opened. The combination of hydrostatic and applied pressure is customarily used to overcome a number of shear pins or to overcome a precision rupture disc. Once communication with the well bore [i.e., area outside of the casing] is achieved, the well can be hydraulically fractured or the valve can be used as an injection port to pump down additional wire line perforating guns, plugs or other conveyance means such as well tractors. Other known methods of establishing communication with the cemented and cased well include tubing conveyed or coil tubing conveyed perforators. These are all common methods to achieve an injection point but require increased time and money.

SUMMARY

An apparatus and method to provide time-delayed injection of pressurized fluid from a well casing to a geological formation, the apparatus comprising:

a housing with openings that can communicate through the walls of the housing to a formation;

a movable piston or pistons capable for covering and sealing the opening(s);

means for moving the piston to position leaving the opening (s) uncovered; and means for activation of the movement of the piston.

The method in broad aspect is the use and activation of the apparatus as described.

DETAILED DESCRIPTION

Figure 1A:
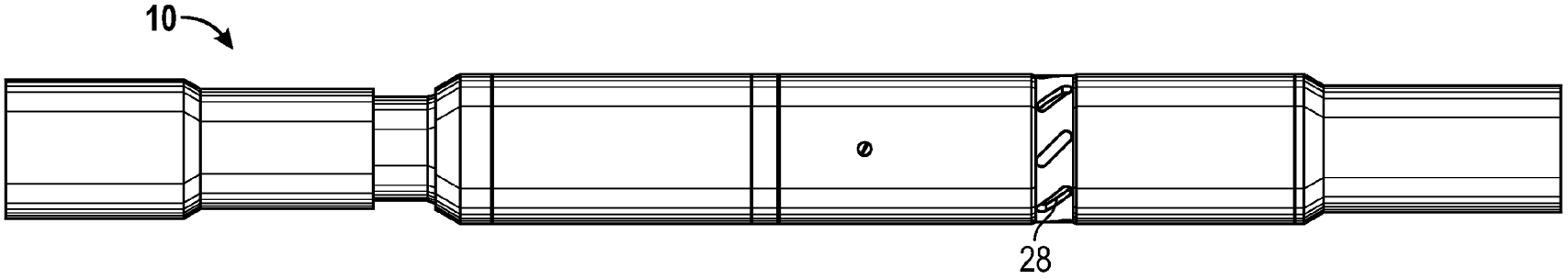
FIG. 1*a* is a plan view t of an apparatus of an embodiment of the invention.

The present invention is an improved toe valve apparatus and method to allow fluid to be pressured through ports in an oil or gas well casing wall (and cement) into a geologic formation.

The apparatus provides time-delayed injection of pressurized fluid through opening in a well casing to a geological formation comprising:

a housing with opening that can communicate through the ports in the walls of the housing to a formation;

a movable piston or pistons capable of covering and sealing the port(s);

means for moving the piston to a final position leaving the port(s) uncovered; and means for activation the movement of the piston.

The present invention represents several improvements over conventional pressure responsive devices—improvements that will be appreciated by those of ordinary skills in the art of well completions. The greatest limitation of current devices is that the sleeve or power piston of the device that allows fluid to flow from the casing to a formation (through openings or ports in the apparatus wall) opens immediately after the actuation pressure is reached. This limits the test time at pressure and in many cases precludes the operator from ever reaching the desired casing test pressure. The present invention overcomes that limitation by providing a hydraulic delay to afford adequate time to test the casing at the required pressure and duration before allowing fluid communication with the well bore and geologic formation. This is accomplished by slowly releasing a trapped volume of fluid through a hydraulic metering chamber that allows a piston covering the ports to move to a position where the ports are uncovered. This feature will become even more advantageous as federal and state regulators mandate the duration or dwell time of the casing test pressure. The metering time can be increased or tailored to a specific test requirement through manipulation of the fluid type, fluid volume and by altering the flow rate of the hydraulic liquid flow restrictor.

A second advantage of this invention is that two or more valves can be installed (run) as part of the same casing installation. This optional configuration of running two or more valves is made possible by the delay time that allows all of the valves to start metering before any of the valves are opened. The feature and option to run two or more valves in a single casing string increases the likelihood that the first stage of the well can be fracture stimulated without any well intervention whatsoever. Other known devices do not allow more than a single valve to operate in the same well since no further actuation pressure can be applied or increased after the first valve is opened.

A third significant advantage is that in the operation the valve, the ports are opened slowly so that as the ports are opened the liquid is injected to the cement on the outside of the casing in a high pressure jet, thus establishing better connection to the foundation. The jet begins as a highly effective pinpoint cutting jet and enlarges as the ports are opened to produce an effect of a guide-hole that is then enlarged.

Figure 1B:
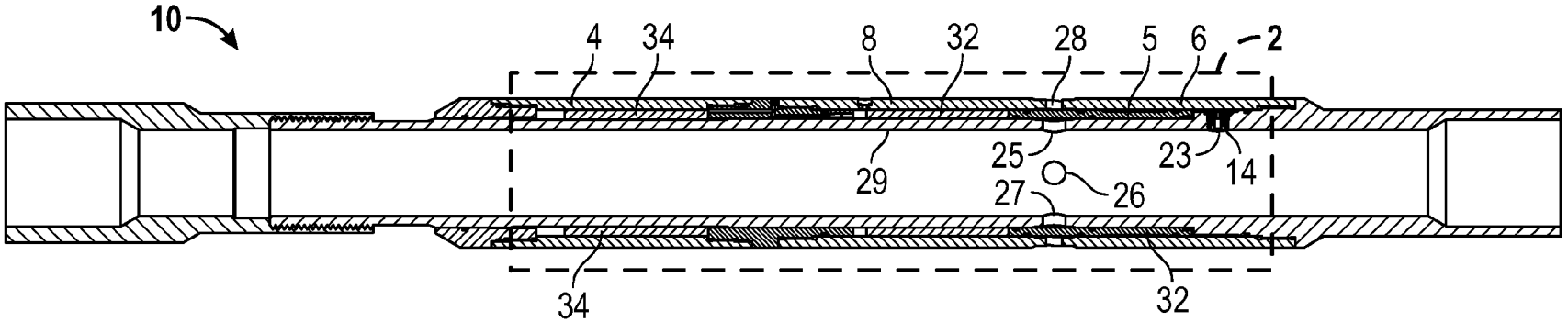
FIG. 1*b* is a plan view of a cross section of an apparatus of an embodiment of the invention.

Referring to the Figures, FIG. 1*a* represents an Inner mandrel that attaches directly to the casing string and shows an overall external view an embodiment of the toe valve apparatus of the invention where item 28 are slot ports through which fluid will be transported into the geologic formation into which the casing is set. FIG. 1*b* shows a cross section view of the apparatus of FIG. 1*a*. The integral one-piece design of the mandrel carries all of the tensile, compressional and torsional loads encountered by the apparatus. The entire toe valve is piped into the casing string as an integral part of the string and positioned where perforation and fluid injection into a formation is desired. The valve may be installed in either direction with no change to the tool function.

Figure 2:
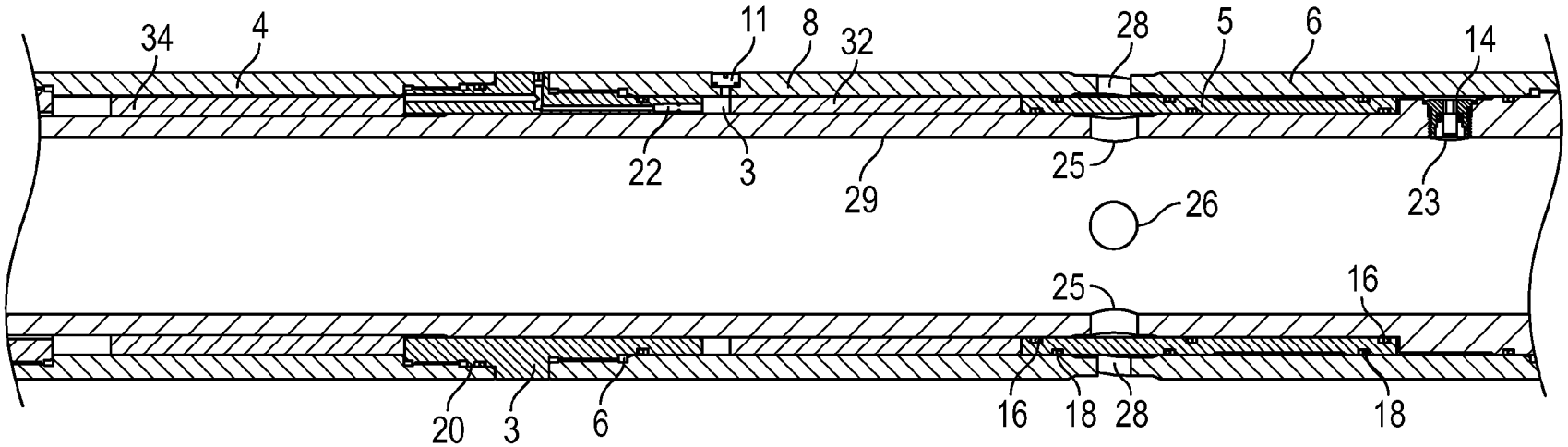
FIG. 2 is an exploded section view of the apparatus displayed in FIGS. 1*a* and 1*b* in which the ports are closed.

FIG. 2 shows an exploded view of details of the hydraulic flow restriction apparatus of an embodiment of the invention—the embodiment shown in FIGS. 1*a* and 1*b*. Item 23 is a pressure activated opening device (preferably a Reverse Acting Disc that resists plugging during the cementing operations, but conventional rupture discs may be used). Since the rupture disc is in place in the casing string during cementing it is very advantageous to have a reverse acting rupture disc that will not be easily clogged and not require extra cleaning effort. The valve mandrel is machined to accept the opening device Item 23 (such as rupture discs) that ultimately controls actuation of the piston, 5. The opening piston, 5, is sealed by elastomeric seals (16, 18 and 20) to cover the inner and outer ports, 28 and 25-27, in the apparatus. A series of outer parts, Items 4, 6, and 8 are threadedly combined to form the fluid and pressure chambers for the tool. The tandem, 3, not only couples item 4 and 5 but also houses the hydraulic restrictor 22. The area above the piston is a fluid chamber and the area above item 3 is the low pressure chamber that accommodates the fluid volume as it traverses across the hydraulic restrictor. The chambers are both capped by the item 8 upper cap.

Figure 3:
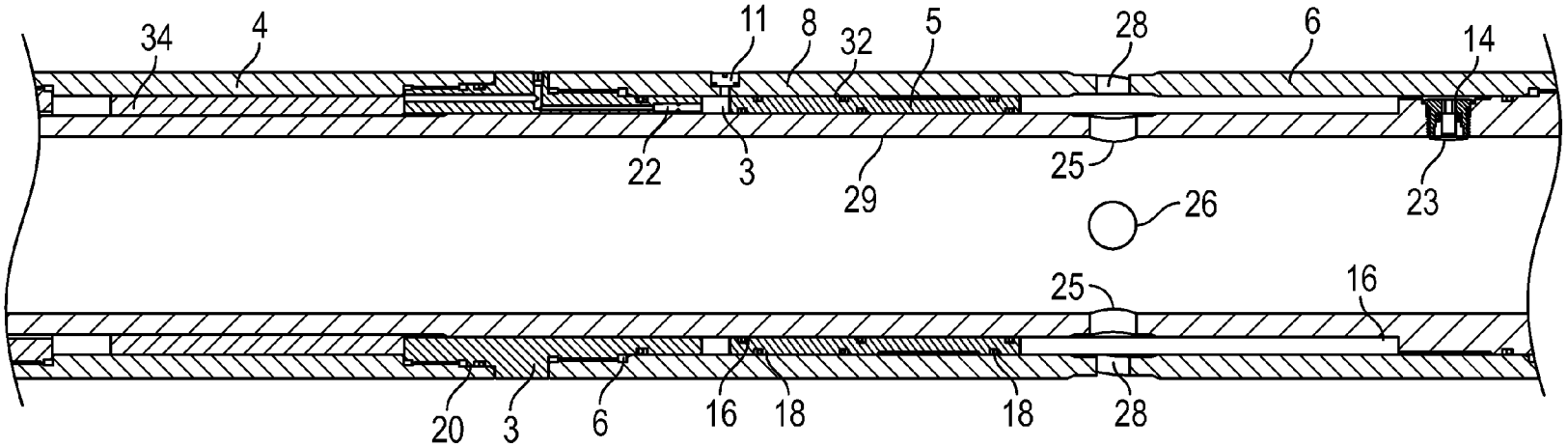
FIG. 3 is an exploded section view of the apparatus displayed in FIGS. 1*a* and 1*b* in which the ports are open.

The rupture disc 23 is the activation device that sets the valve opening operation in play. When ready to operate (i.e., open the piston), the casing pressure is increased to a test pressure condition. This pressurization process ruptures the rupture disc 23 and fluid at casing pressure (hydrostatic, applied or any combination) enters the chamber immediately below and adjacent to the piston 5. This entry of fluid causes the piston 5 to begin moving. This fluid movement allows the piston to move inexorably closer to an open position. In actual lab and field tests the piston movement of about 4.5 inches begins to uncover the openings 27-29 and slot 28. These openings are closed or sealed off from the casing fluid by the piston 5. As piston 5 moves toward the open and final position, the openings, 25-27, are uncovered allowing fluid to flow through openings 25, 26 and 27 through slots 28. Thus, the restrained movement of the piston allows a time delay from the time the disc is ruptured until the slots uncovered for fluid to pass. This movement continues until the piston has fully opened. As fluid pressure increases through port 14 it moves piston 5 into the fluid chamber 32. Piston 5 surrounds the wall of the mandrel 29. Hydraulic fluid in the fluid chamber restrains the movement of the piston. There is a hydraulic flow restrictor 22 that allows fluid to pass from chamber 32 to lower pressure chamber 34. This flow restrictor controls the rate of flow of fluid from chamber 32 to chamber 34 and thereby the speed of the movement of the piston as it moves to the full open position. Items 28 are the slots in the apparatus mandrel that will be the passageway for fluid from the casing to the formation. FIG. 3 shows the position of piston 5 when "opened" by moving into chamber 32. Initially, this movement increases pressure in the fluid chamber to a value that closely reflects the hydrostatic plus applied casing pressure. There is considerable predetermined control over the delay time by learned manipulation of the fluid type, fluid volume, initial charging pressure of the low pressure chamber and the variable flow rate through the hydraulic restrictor. The time delay can set as desired but generally will be about 5 to 60 minutes. Any hydraulic fluid will be suitable if capable of withstanding the pressure and temperature conditions that exist in the well bore. Those skilled in the art will easily be able to select suitable fluids such as Skydrol500B-4™. In operation an apparatus of the invention will be piped into a casing string at a location that will allow fluid injection into the formation where desired. The apparatus may be inserted into the string an either direction. An advantage of the present invention is that two or more of the toe values of the invention may be used in the string. They will, as explained above, open to allow fluid penetration at multiple locations in the formation.

In general the apparatus will be constructed of tool steel of about the same type used incasing.

A prototype apparatus had the general dimensions of 60 inches in lengths, with a nominal outside diameter of 6.5 inches and an inside diameter of 3.75 Inches. Other dimensions as appropriate for the well and operation in which the apparatus is intended to be used are intended to be included in the invention and may easily be determined by those skilled in the art.

Figure 4:
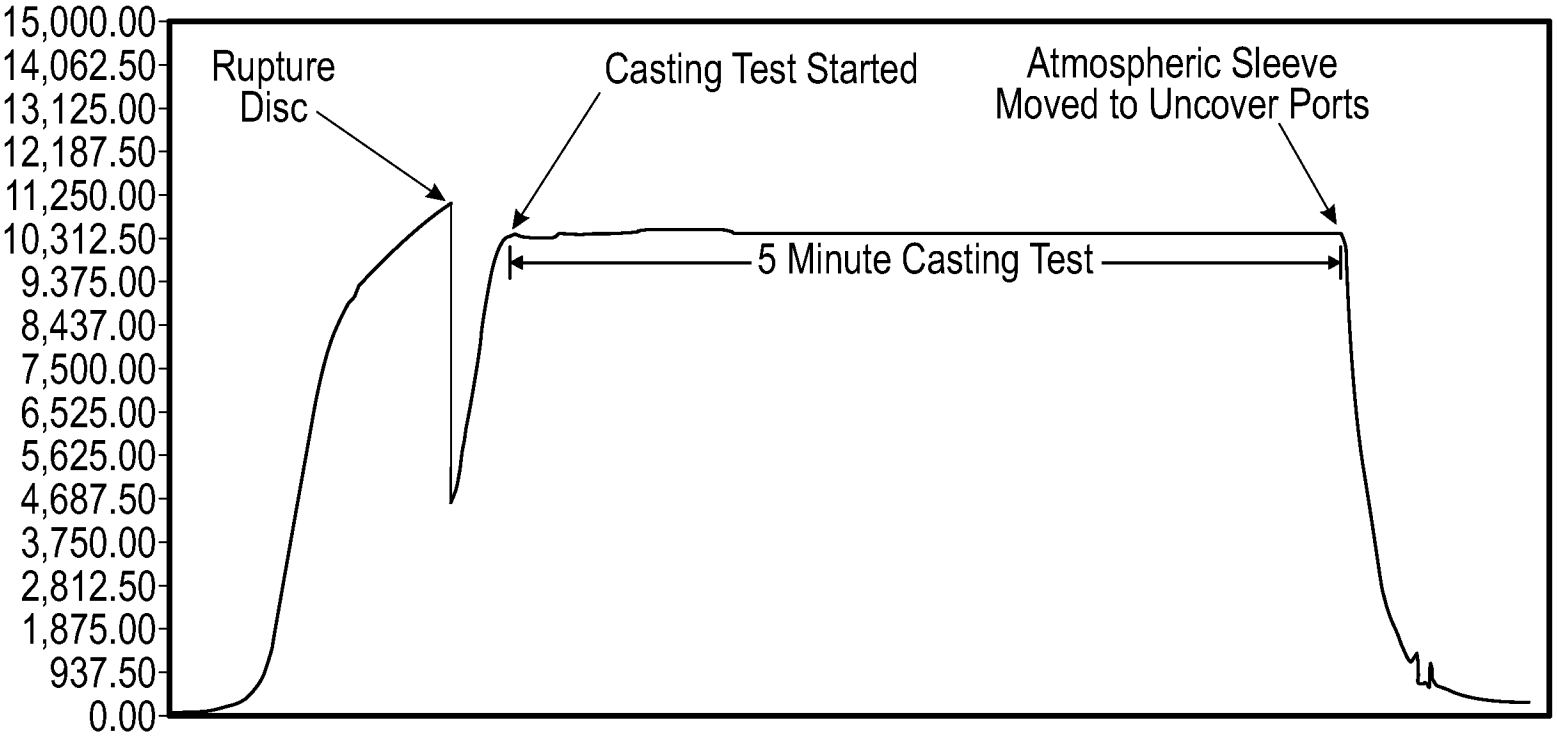
FIG. 4 is a graphic representation of results of a test of the operation of an apparatus of an embodiment of the invention.

FIG. 4 represents the results of a test of a prototype of the apparatus. As shown, a 5 minute test shows constant pressure for 5 minutes while the piston movement uncovered openings in the apparatus.

In the foregoing specification, the invention has been described with reference to specific embodiments thereof. It will, however, be evident that various modifications and changes can be made thereto without departing from the broader spirit and scope of the invention as set forth in the appended claims. The specification is, accordingly, to be regarded in an illustrative rather than a restrictive sense. Therefore, the scope of the invention should be limited only by the appended claims.

The invention claimed is:

1. An apparatus to provide time-delayed injection of pressurized fluid from a well casing into a geological formation comprising:

a housing with openings that allows fluid to pass through the openings to the formation;

a mandrel, wherein the mandrel is a one piece design that is configured to carry all of the tensile, compressional and torsional loads of said apparatus;

a movable piston configured to cover the openings in a closed position;

means for moving the piston to an open position leaving the openings uncovered;

means for activating a movement of the piston from the closed position;

whereby, as the piston moves from the closed position into a high pressure chamber comprising a hydraulic fluid, the piston is restrained in movement by a passage of the hydraulic fluid from the high pressure chamber into a low pressure chamber through a liquid flow restrictor, and the movement of the piston from the closed position to the open position is delayed by a predetermined metering time.

2. The apparatus of claim 1 wherein the movable piston surrounds an inner circumference of the housing and the activation means is a rupture disc activated by pressure.

3. The apparatus of claim 2 wherein the rupture disc is a reverse acting rupture disc; the reverse acting rupture disc is configured to resist blockage by concrete.

4. The apparatus of claim 1 configured and sized to mate with the well casing.

5. The apparatus of claim 1 wherein the predetermined metering time is 5 minutes.

6. The apparatus of claim 1 wherein the predetermined metering time ranges from 5 minutes to 60 minutes.

7. The apparatus of claim 1 wherein a length of the apparatus is 60 inches.

8. The apparatus of claim 1 wherein an outside diameter of the apparatus is 6.5 inches.

9. The apparatus of claim 1 wherein an inside diameter of the apparatus is 3.75 inches.

10. The apparatus of claim 1 wherein the apparatus is made from tool steel.

11. The apparatus of claim 1 wherein the predetermined metering time is controlled by the hydraulic fluid type.

12. The apparatus of claim 1 wherein the predetermined metering time is controlled by the hydraulic fluid volume.

13. The apparatus of claim 1 wherein the predetermined metering time is controlled by a flow rate in the hydraulic flow restrictor.

14. A method of injecting pressured fluid from a well casing to a geological formation, comprising:

providing a housing with openings that allows fluid to pass through the openings to the formation;

providing a movable piston configured to cover openings in a closed position;

providing means for moving the piston to an open position leaving the openings uncovered;

providing means for activating a movement of the piston from the closed position; and whereby, as the piston moves from the closed position into a high pressure chamber comprising a hydraulic fluid, the piston is restrained in movement by a passage of the hydraulic fluid from the high pressure chamber into a low pressure chamber through a liquid flow restrictor, and the movement of the piston from the closed position to the open position is delayed by a predetermined metering time;

injecting the pressured fluid in the well casing to a desired pressure;

activating the piston to move from the closed position;

delaying the time of the piston movement to the open position for the predetermined metering time;

uncovering the openings in the housing; and maintaining pressure on the pressured fluid to force the pressured fluid into the formation.

15. The method of claim 14 wherein the movable piston surrounds an inner circumference of the housing and the activation means is a rupture disc activated by pressure.

16. The method of claim 15 wherein the rupture disc is a Reverse Acting Disc.

17. The method of claim 15 wherein the rupture disc is burst by pressure above the desired working pressure of the fluid in the well casing, releasing pressure on one end of the piston to move the piston from the closed position into the high pressure chamber and wherein the piston movement displaces the hydraulic fluid from the high pressure chamber.

18. The method of claim 14 wherein at least two of the apparatuses are placed in the well casing.

19. The method of claim 18 wherein a first stage in the well casing is fracture stimulated by at least one of said apparatus.

20. The method of claim 14 wherein the predetermined metering time is chosen such that movement of the piston creates a high pressure jet through the casing and a cement sheathe surrounding the casing; said high pressure jet is created by substantially slowly moving the piston to uncover the openings.

21. The method of claim 14 wherein the apparatus is placed in the well casing in either direction.

22. The method of claim 14 wherein the predetermined metering time is controlled by the hydraulic fluid type.

23. The method of claim 14 wherein the predetermined metering time is controlled by the hydraulic fluid volume.

24. The method of claim 14 wherein the predetermined metering time is controlled by a flow rate in the hydraulic flow restrictor.

25. An apparatus to provide injection of pressurized fluid from a well casing into a geological formation comprising:

a housing with openings that allows fluid to pass through the openings to the formation;

a movable piston configured to cover the openings in a first closed position; means for moving the piston to a second open position leaving the openings uncovered;

means for activating a movement of the piston from the first closed position;

whereby, when the piston moves from the first closed position into a high pressure chamber comprising a hydraulic fluid, the piston is restrained in movement by a passage of the hydraulic fluid from the high pressure chamber into a low pressure chamber through a liquid flow restrictor, and the movement of the piston from the first closed position to the second open position is delayed by a predetermined metering time; and whereby the openings are opened substantially slowly so that as the openings are opened, the fluid is injected to the formation in a high pressure jet.

26. The apparatus of claim 25 wherein the high pressure jet begins as a pinpoint cutting jet and enlarges as the openings are opened to produce the effect of a guide hole with no flow restriction.

27. The apparatus of claim 25 wherein there is a time delay to begin to open the openings.

28. The apparatus of claim 25 wherein the piston moves from the first closed position to the second open position without a time delay.

* * * * *